US011045857B2

(12) United States Patent
Swedberg

(10) Patent No.: US 11,045,857 B2
(45) Date of Patent: Jun. 29, 2021

(54) FLUID-COOLED TOOLPACK

(71) Applicant: Pride Engineering, LLC, Minneapolis, MN (US)

(72) Inventor: Rick Swedberg, Minneapolis, MN (US)

(73) Assignee: Pride Engineering, LLC, Minneapolis, MN (US)

( * ) Notice: Subject to any disclaimer, the term of this patent is extended or adjusted under 35 U.S.C. 154(b) by 170 days.

(21) Appl. No.: 15/987,617

(22) Filed: May 23, 2018

(65) Prior Publication Data

US 2019/0358691 A1 Nov. 28, 2019

(51) Int. Cl.

| | |
|---|---|
| ***F28D 15/02*** | (2006.01) |
| ***B21D 22/28*** | (2006.01) |
| ***B21D 37/16*** | (2006.01) |
| ***B21D 51/26*** | (2006.01) |

(52) U.S. Cl.

CPC ..... *B21D 22/286* (2013.01); *B21D 37/16* (2013.01); *B21D 51/26* (2013.01); *F28D 15/02* (2013.01)

(58) Field of Classification Search

CPC ..... B21C 29/04; B21D 22/286; B21D 37/16; B21D 51/26

USPC ..... 72/342.2, 342.3, 347–349; 266/259, 260

See application file for complete search history.

(56) References Cited

U.S. PATENT DOCUMENTS 2,252,365 A * 8/1941 Fisher ..... B21C 3/14 72/463
3,656,335 A * 4/1972 Kaminski ..... B21D 22/28 72/349
3,740,990 A 6/1973 Prajsnar
4,109,707 A * 8/1978 Wilson ..... F28F 3/12 165/170
4,300,375 A 11/1981 Maeder
5,154,661 A * 10/1992 Higgins ..... F25B 21/02 62/3.2
5,544,487 A * 8/1996 Attey ..... H02K 5/12 62/3.7
6,047,587 A 4/2000 Naggert
6,598,450 B2 7/2003 Blue
(Continued)

FOREIGN PATENT DOCUMENTS

CN 103438741 A * 12/2013 ..... F28D 15/0266
KR 960008800 10/1996

OTHER PUBLICATIONS

Tillman Steinbrecher, "The Heatsink Guide: Noise reduction", Dec. 14, 2001, PHAM (Year: 2001).*
(Continued)

*Primary Examiner* — Adam J Eiseman
*Assistant Examiner* — Dylan Schommer
(74) *Attorney, Agent, or Firm* — Neustel Law Offices

(57) ABSTRACT

A fluid-cooled toolpack for cooling can-forming dies without allowing cooling fluid to contaminate or contact the cans or the interior of the can bodymaker during production. The fluid-cooled toolpack generally includes a chill plate that is biased with a spring into contact with a can-forming die. The chill plate may be generally ring shaped and include annular heat pipes to carry heat away from the can-forming die to a set of heatsink fins at the top of the chill plate. Cooling fluid, such as water or air, can be used to remove heat from the heatsink fins. The chill plate can also be used to preheat the can-forming die before the equipment is used if desired, since the heat transfer of the system is non-directional.

16 Claims, 10 Drawing Sheets

(56) References Cited

U.S. PATENT DOCUMENTS

| | | | | |
|---|---|---|---|---|
| 6,598,451 | B2 | 7/2003 | Blue | |
| 7,028,757 | B1 * | 4/2006 | Hegde | F28D 15/0275 165/104.21 |
| 7,526,938 | B2 | 5/2009 | Dunwoody | |
| 7,555,926 | B2 | 7/2009 | Trim | |
| 7,805,970 | B2 * | 10/2010 | Woulds | B21D 37/16 72/349 |
| 8,656,750 | B2 | 2/2014 | Horton | |
| 8,683,837 | B2 | 4/2014 | Mallory | |
| 9,079,238 | B2 | 7/2015 | Crabtree | |
| 9,399,248 | B2 | 7/2016 | Fleischer | |
| 9,630,234 | B2 | 4/2017 | Blue | |
| 9,707,615 | B2 | 7/2017 | Dick | |
| 2002/0179285 | A1 | 12/2002 | Sas | |
| 2004/0190251 | A1 | 9/2004 | Prasher | |
| 2005/0087329 | A1 * | 4/2005 | Zhang | H01L 23/467 165/104.33 |
| 2007/0175258 | A1 | 8/2007 | Bowen | |
| 2008/0229801 | A1 | 9/2008 | Woulds | |
| 2011/0239726 | A1 | 10/2011 | Crabtree | |
| 2013/0155616 | A1 * | 6/2013 | Tong | H05K 7/20909 361/696 |
| 2013/0205862 | A1 * | 8/2013 | Takahashi | B21D 37/16 72/342.3 |

OTHER PUBLICATIONS

International Search Report and Opinion for PCT/US19/29664; dated Jul. 10, 2019.

* cited by examiner

SECTION A-A

FLUID-COOLED TOOLPACK

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a fluid-cooled toolpack for cooling can-forming dies used for the final forming of metal containers.

Related Art

Any discussion of the related art throughout the specification should in no way be considered as an admission that such related art is widely known or forms part of common general knowledge in the field.

In can-making equipment, metal cans are generally formed by a bodymaker punch or ram that draws and irons metal cup blanks. The bodymaker makes containers by deepening the cup and reducing the wall thickness as the ram moves axially through the bodymaker, until a can with the modern well-known shape is formed. Typically, toolpacks are used in conjunction with the ram to provide controlled reduction in the thickness of the container wall as it is drawn and ironed in the bodymaker. A by-product of this process is unwanted heat in the equipment. In some conventional can makers, the dies are cooled with liquid, such as water, that is not isolated from the can-making process—in other words, the liquid can and does make contact with the cans, the dies, and the ram. As a result, the cans require additional cleaning steps before they are ready for finishing and use.

SUMMARY

The invention generally relates to an isolated heat transfer apparatus for can making equipment. An example embodiment comprises a ring-shaped chill plate in intimate contact with a die, and further includes embedded heat pipes to carry heat away from the interface between the die and the chill plate. The example embodiment also includes a heat transfer device to further transfer heat from the heat pipes to a cooling medium that flows over a series of cooling fins.

In use, the can-making process will generate heat in the dies which must be removed. In other systems, unwanted heat is removed by allowing cooling and lubricating fluid to flow over the inner portion of a bodymaker during can making. This fluid must then be removed in a separate process before cans can be finished, filled and used. In an example embodiment, instead of direct liquid cooling, heat pipes are used to carry heat away (or toward) the chill plate 10 and thus the associated dies, which cools the dies without allowing any cooling fluid to contact the cans being made or the interior of the can bodymaker.

In operation, the heat generated by the can making process (i.e., drawing and ironing) is transferred first from the die 43, which is in thermal contact with the chill plate 10. Specifically, the chill plate 10 is in contact, or thermally coupled, to the backside of the die 43. By locating the chill plate on the backside of the die, the chill plate is not subjected to direct force when the ram pushes a can through the die. Heat is then transferred from the body of chill plate 10 into the heat pipes 11 around the chill plate 10 to the heatsink fins 12 near the top of the toolpack module 20, and the heatsink fins 12 in turn are cooled by a cooling medium, which flows over the heatsink fins 12 within shroud 13, using fluid-tight connections to prevent fluid from entering the interior of toolpack module 20. The cooling fluid is isolated from the interior of the can bodymaker.

The chill plate 10 may include a temperature sensor 50, which can be used in conjunction with a controller 62 to regulate the temperature of the chill plate. If so, the controller can be used to control a valve 61 that controls the flow of cooling fluid supplied to the heatsink fins 12 of the chill plate, through the bodymaker cradle lid. Temperature control is not necessary, however, and alternatively, the chill plate can be used to remove heat as determined by the thermal efficiency of the chill plate 10, as well as the flow rate and temperature of the cooling fluid.

There has thus been outlined, rather broadly, some of the embodiments of the fluid-cooled toolpack in order that the detailed description thereof may be better understood, and in order that the present contribution to the art may be better appreciated. There are additional embodiments of the fluid-cooled toolpack that will be described hereinafter and that will form the subject matter of the claims appended hereto. In this respect, before explaining at least one embodiment of the fluid-cooled toolpack in detail, it is to be understood that the fluid-cooled toolpack is not limited in its application to the details of construction or to the arrangements of the components set forth in the following description or illustrated in the drawings. The fluid-cooled toolpack is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
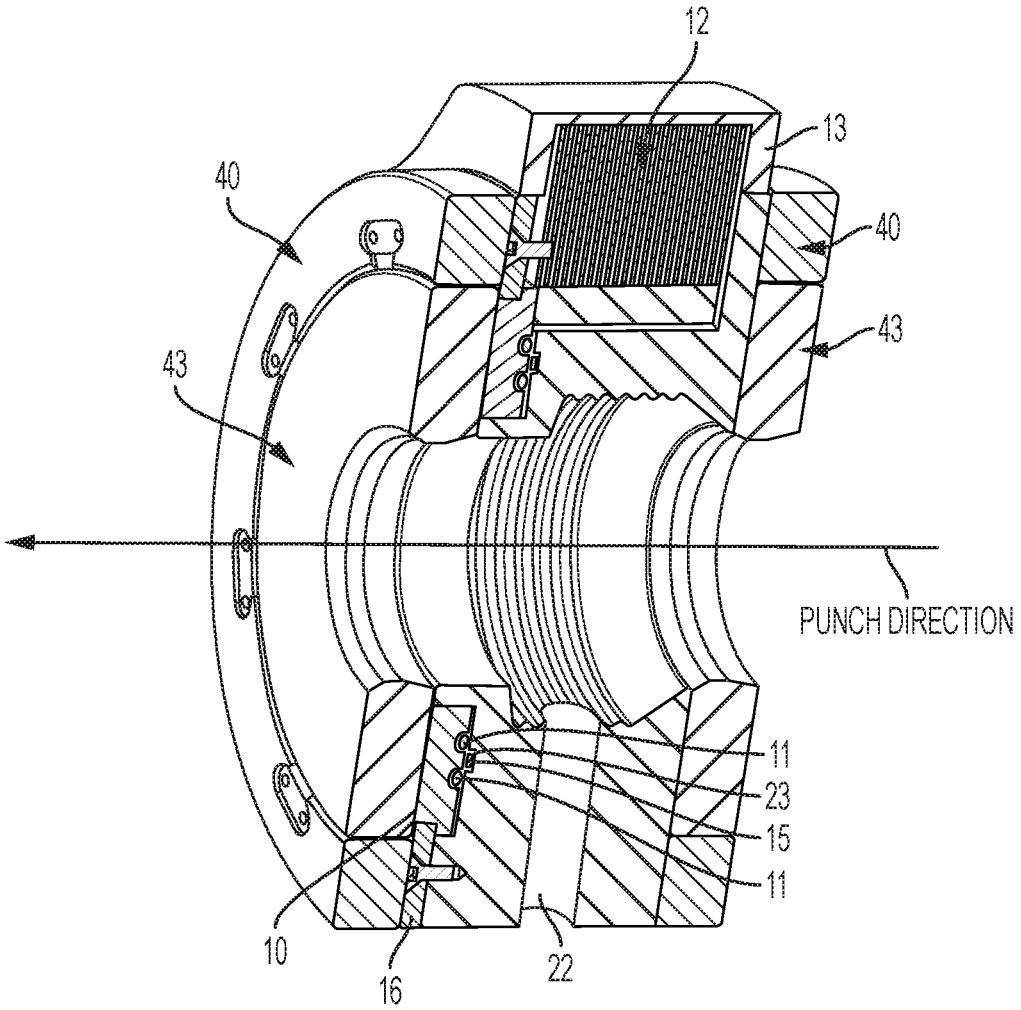
FIG. 1 is a sectional perspective view of a toolpack module in accordance with an example embodiment.

An example embodiment of a fluid-cooled toolpack generally comprises an apparatus that removes heat from the can making process without exposing the dies, ram, or cans to the cooling medium. The fluid-cooled toolpack provides for the cooling of can-forming equipment with a fluid (i.e., liquid or gas) that is isolated from the interior cavity of the bodymaker. As known in the can making industry, a bodymaker typically comprises a number of toolpack modules held in a bodymaker toolpack cradle 30. In an example embodiment, the bodymaker can include multiple floating die modules 40 that employ floating die module springs 41 and floating die module support pins 42 to hold can-forming dies 43 in place while still allowing the dies to float and self-center. As the ram moves into the bodymaker, each die progressively thins the walls of the can and deepens the can. Further, in the example embodiment, the multiple can-forming dies 43 are separated by spacers 21.

The fluid-cooled toolpack generally includes a chill plate 10 that is biased into intimate contact with a floating die by a chill plate spring 15. The surface of the chill plate contacts the back surface of the die so that there is good heat transfer between the die and the chill plate. The chill plate 10 may be generally ring shaped, and may further include one or more heat pipes 11 that carry heat away from the chill plate to a number of heatsink fins 12. The heatsink fins 12 may be contained in a shroud 13 having inlets/outlets 14 for directing and containing a cooling fluid (e.g., air or water) which flows over the heatsink fins 12, further removing heat from the can-making process by transferring it to the cooling fluid.

Because it is spring loaded and contacts the back side of a die, an example embodiment of the fluid-cooled toolpack can advantageously be used on a "floating die" toolpack assembly like the one disclosed in U.S. Pat. No. 4,554,815, which is hereby incorporated by reference in its entirety. As disclosed in the '815 patent, in a floating toolpack assembly, the ironing and guiding dies are allowed to move or "float" in a radial direction to compensate for any shift in alignment between the ram and the dies. This float allows for automatic centering of the dies and results in better operation of the toolpack. The floating dies may also rotate within the floating die module due to forces generated by the can-making process—such as by off-center hits—which, combined with the radial float, reduces wear on the bodymaker, dies, and ram.

B. Chill Plate

One component of an example embodiment of the invention, as discussed briefly above, is a chill plate 10. The chill plate 10 may advantageously be mounted to contact the back side of its associated can-forming die 43, so that forces from the ram are not transferred to the chill plate 10, and also so that the front surface of chill plate 10 is constantly biased into contact with the can-forming die 43 while also allowing the die to float as described above.

Figure 8A:
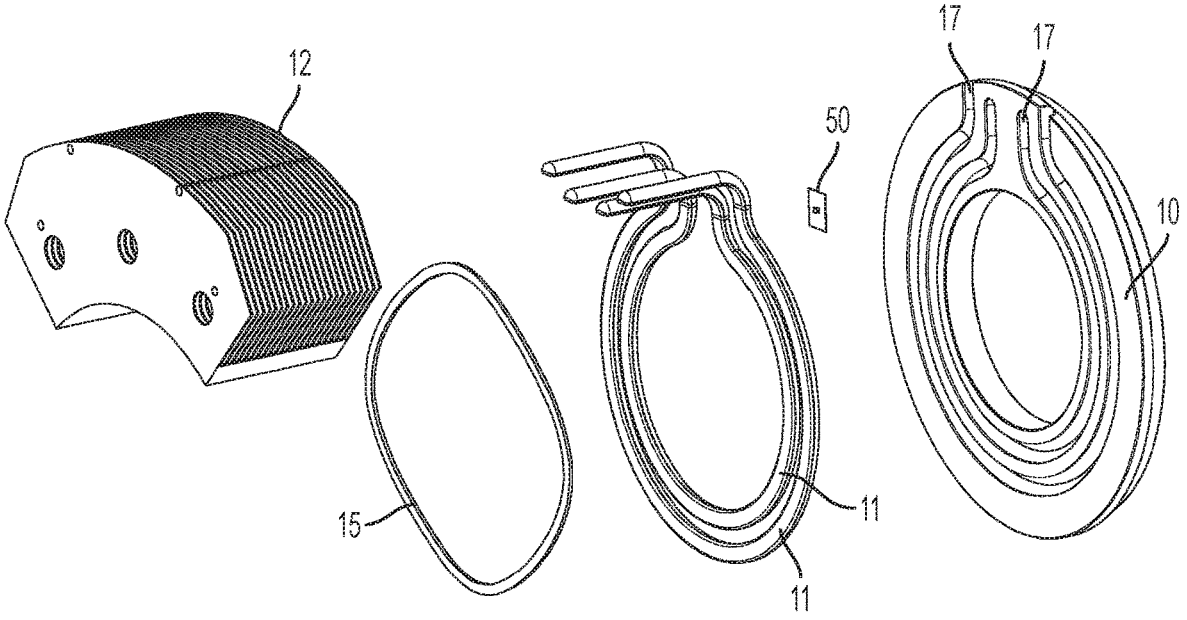
FIG. 8A is an exploded perspective view of a chill plate in accordance with an example embodiment.
Figure 8B:
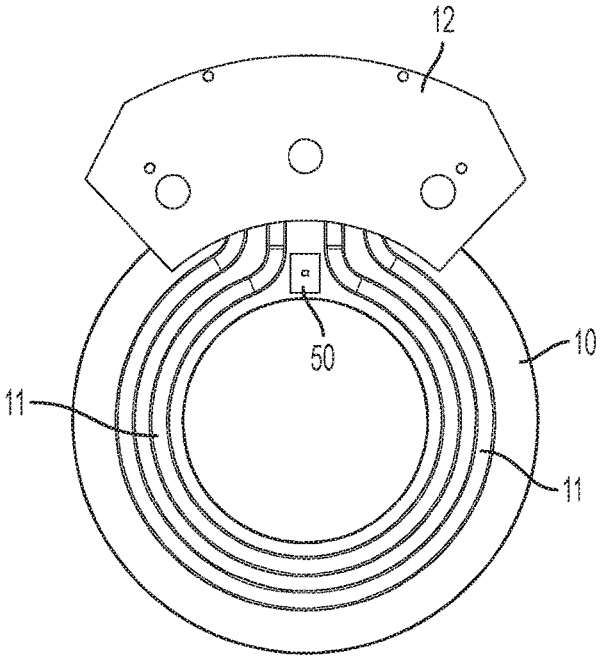
FIG. 8B is an alternative end view of a chill plate in accordance with an example embodiment.

As best shown in FIGS. 8A & 8B, the back side of chill plate 10 has a number of generally annular-shaped grooves that accept heat pipes 11, which effectively transfer heat away from the chill plate and its associated can-forming die and into the heatsink fins 12. The operation of heat pipes is well known and will not be repeated at length here. The important principle is that heat pipes are capable of transferring energy, in the form of heat, from one point to another with very high efficiency. In the example embodiment, when used to cool a die, the annular portion of the heat pipes are the "hot" end, and the ends that are in contact with the heatsink fins are the "cold" end. Notably, the direction of heat transfer can be reversed if it is desired to preheat the can-forming die or dies, which may be desirable in a number of circumstances.

For example, part tolerances in can-making equipment are extremely tight, and can be affected by temperature; thus, a user may want to preheat the dies to a temperature near the working temperature before starting the can-making process to ensure accuracy. As also shown in FIGS. 8A & 8B, the chill plate may include an RTD (resistance temperature detector) or other temperature sensor to measure and control the temperature of the chill plate by regulating the flow of the cooling fluid over the heatsink fins. The RTD may have surface mounted or embedded leads (not shown) to conduct a temperature signal to contact points that may be contacted by corresponding contact points in the cradle lid 31, or another part of the bodymaker, so that no separate connectors or wiring is needed to measure the temperature. Alternatively, the temperature signal may be transmitted to other points in the system via wireless data transmission. In this way, simply installing the toolpack module in the bodymaker toolpack cradle will establish the electrical connection for the temperature sensor.

Figure 10:
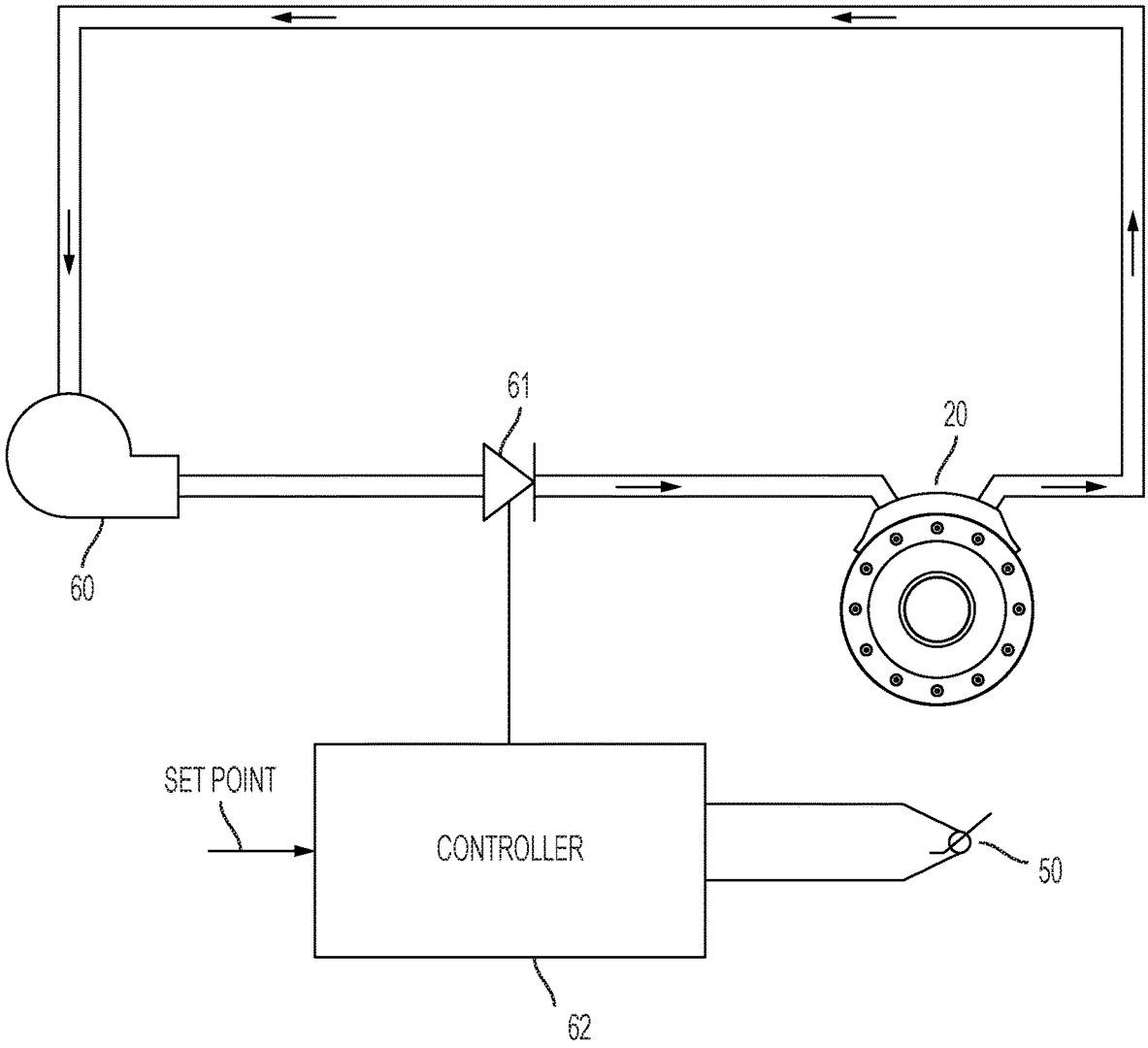
FIG. 10 is schematic of a chill plate and associated temperature control and cooling/heating components in accordance with an example embodiment.

Although other algorithms can be used, the temperature of the chill plate can be controlled using a simple closed loop proportional control, shown schematically in FIG. 10. In a closed loop mode, the chill plate temperature is constantly measured by RTD 50 or other temperature sensor. The measured temperature is an input to controller 62, which compares it to a setpoint, and the error (the difference between the measured temperature and the setpoint) is used to drive a device, such as valve 61, to cause the measured temperature to move toward the setpoint temperature. The cooling fluid can be circulated to chill plate 10 by a pump 60, or may be supplied from a water line or other source. In addition to a valve 61, other devices may be controlled, such as heaters or coolers. In use, if the chill plate temperature is higher than the setpoint, the controller 62 can open valve 61 to increase the flow of cooling fluid over the heatsink fins to decrease the temperature of the chill plate 10 and, correspondingly, the die 43. In an example embodiment, the control signal sent to valve 61 can be proportional to the temperature difference between the setpoint and the measured temperature. Since heat pipes are not directional, this same process can also be used to increase the temperature to preheat the chill plate and associated die, as discussed above.

As with other heat pipes, the heat pipes of the example embodiment have a working fluid that evaporates where the temperature is high and condenses where it is lower. The heat pipes 11 may have a round cross section, or as in an example embodiment, may be somewhat flattened as shown in FIG. 8A. The heat pipes, especially if flattened, may be flush with or below the back surface of the chill plate (i.e., the surface opposite the die) to prevent damage and to maximize heat transfer. In the example embodiment, the condensed working fluid can flow back to the hotter portion of the heat pipes by gravity. As shown in FIG. 8A, the heatsink fins 12 may be positioned at or near the top of the chill plate to facilitate the flow of the condensed working fluid back to the hotter region of the chill plate 10.

Figure 6B:
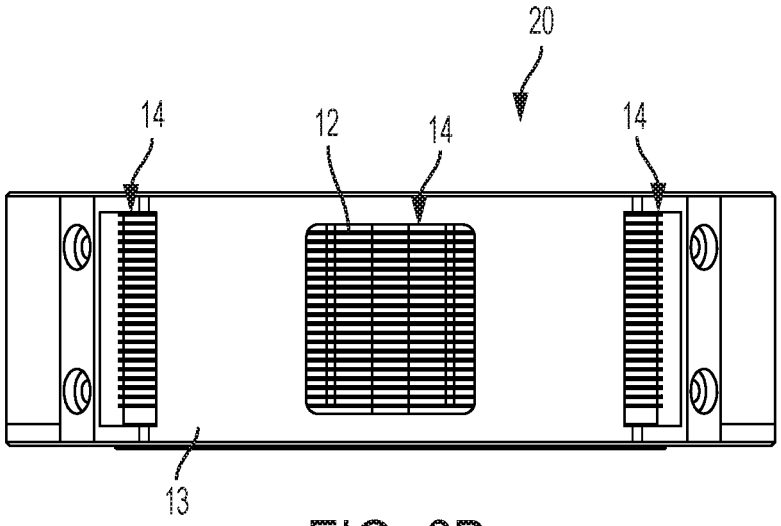
FIG. 6B is a top view of FIG. 6A in accordance with an example embodiment.
Figure 6A:
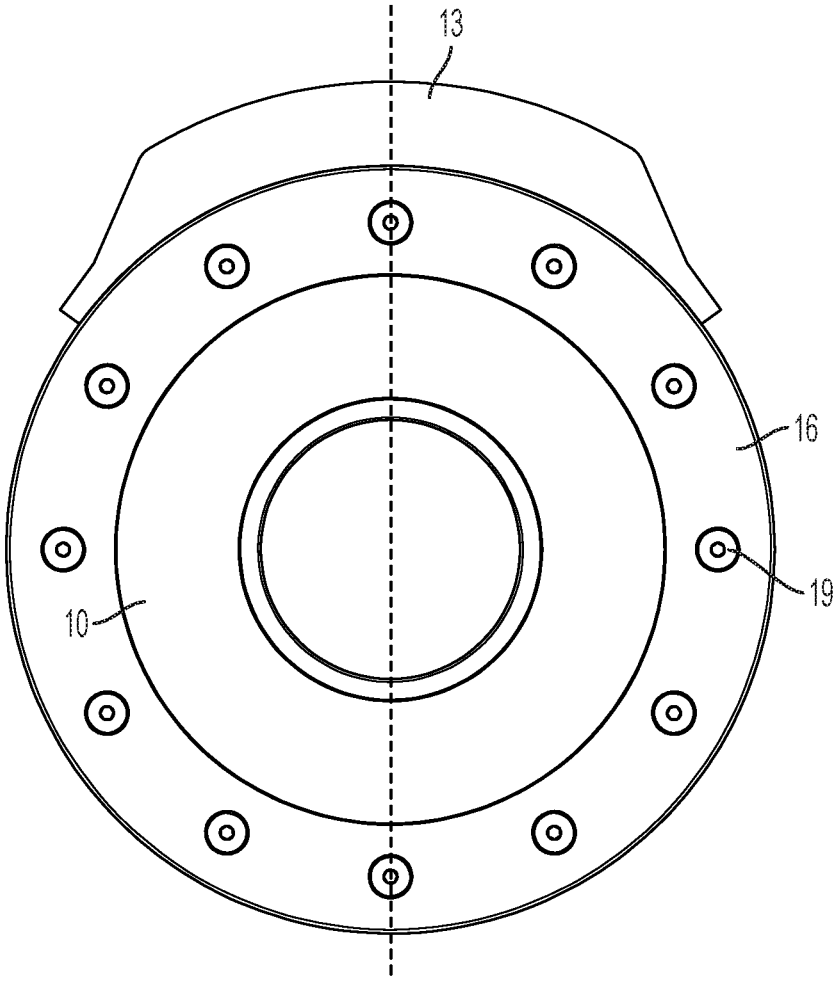
FIG. 6A is an end view of a chill plate and chill plate retention ring in accordance with an example embodiment.

In an example embodiment, the annular portion (i.e., the "hot" end) of heat pipes 11 are designed to fit tightly into the set of heat pipe grooves 17 formed in one side of the chill plate 10. The heat pipes may be press fit into grooves 17, or they may be chemically bonded in place. They may also be soldered in place. The other, "cold" end of the heat pipes 11 may be bonded, press fit, or soldered to a plate or other structure that holds the set of heatsink fins 12, to effectively transfer heat to them. The junction between the heat pipes and the chill plate and the heatsink plate is designed for maximum contact and thus good heat transfer. As best shown in FIG. 6B, the heatsink fins 12 may be enclosed in a heatsink shroud 13 that will contain and isolate the cooling medium (or heating medium, depending on the application) from the interior cavity of the bodymaker. The cooling medium, such as water or air, enters and leaves the heatsink assembly via cooling media inlets/outlets 14, which allows the heatsink fins 12 to be exposed to and cooled (or heated) by the medium.

Figure 4:
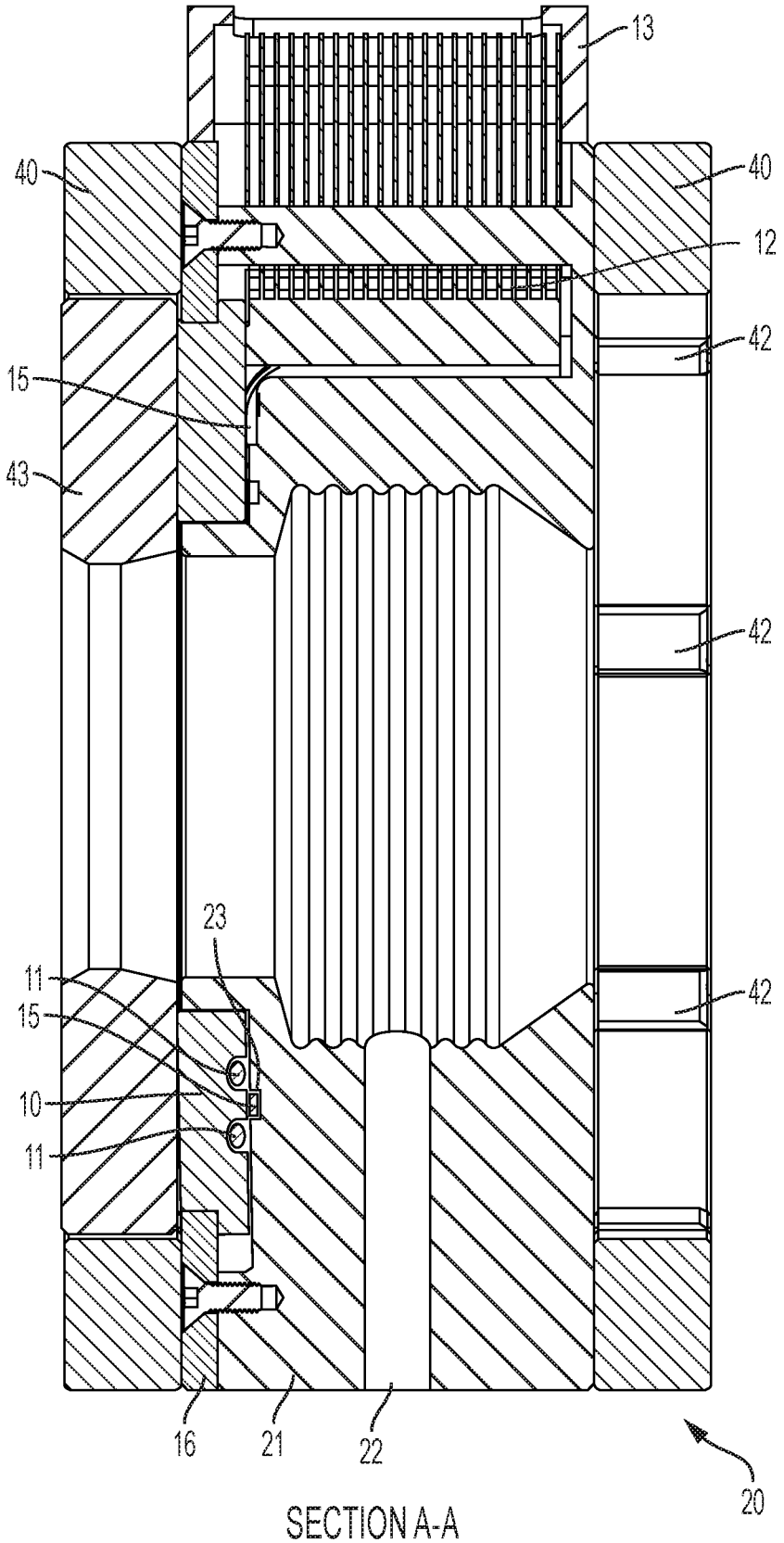
FIG. 4 is a sectional side view of a toolpack module in accordance with an example embodiment taken along line A-A of FIG. 3A.
Figure 5C:
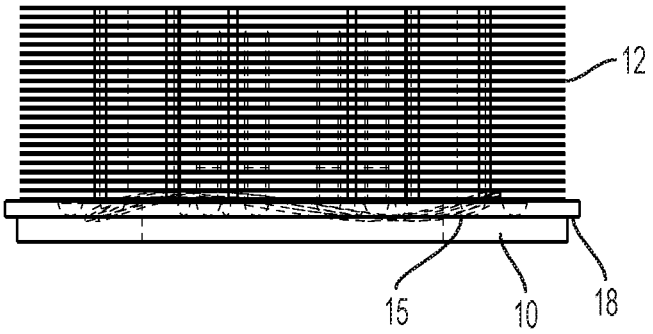
FIG. 5C is a top view of a chill plate in accordance with an example embodiment.
Figure 5A:
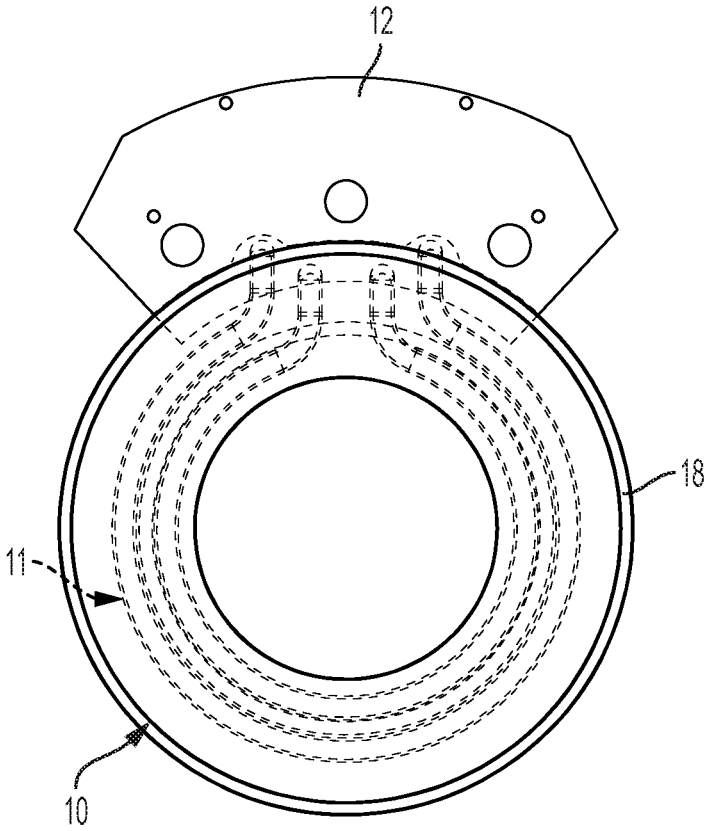
FIG. 5A is an end view of a chill plate in accordance with an example embodiment.
Figure 5B:
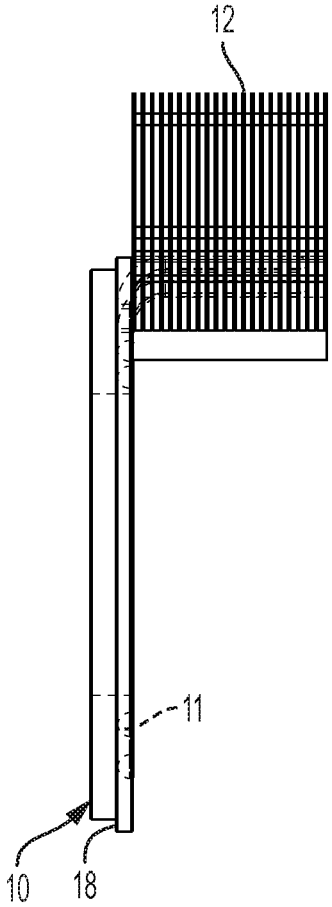
FIG. 5B is a side view of a chill plate in accordance with an example embodiment.
Figure 7:
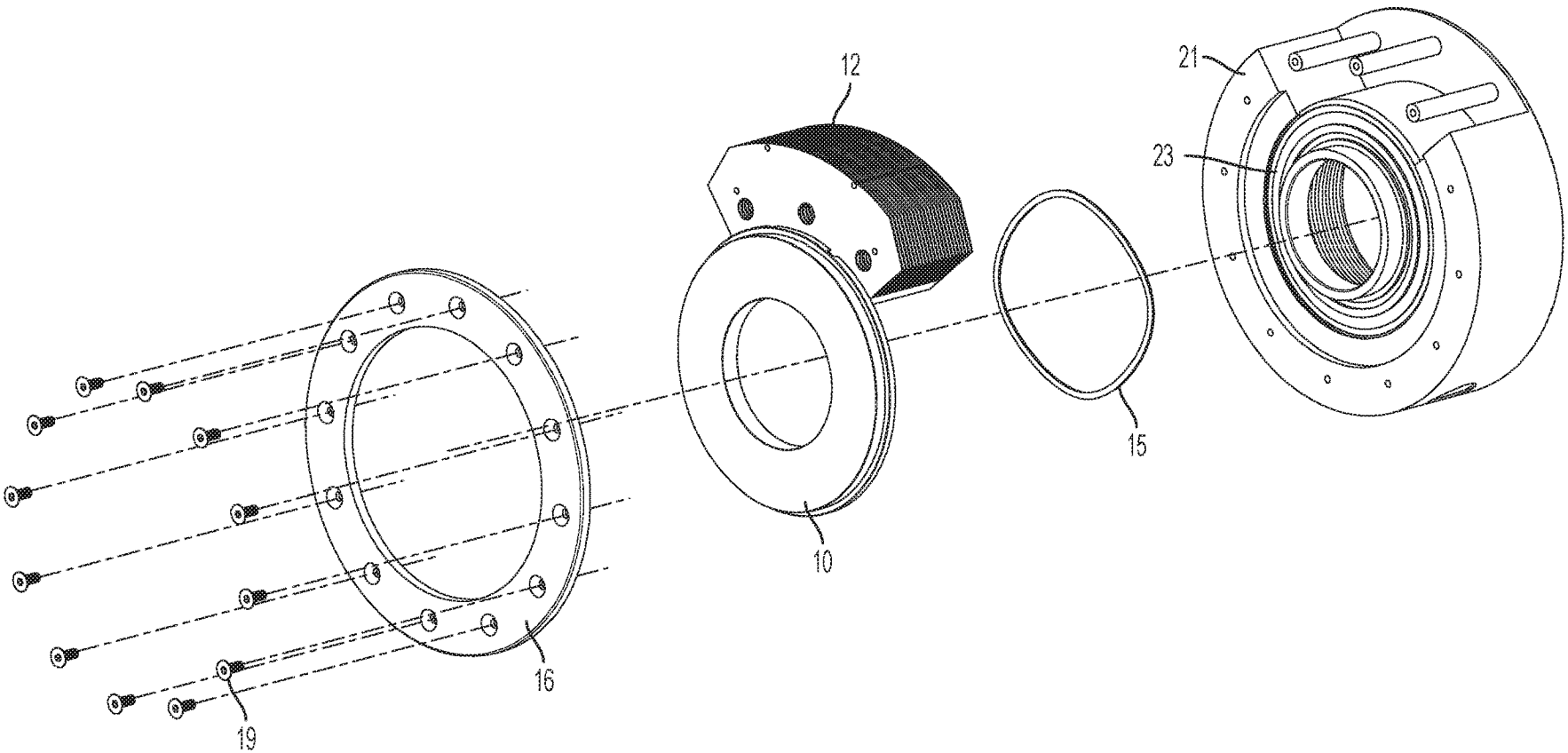
FIG. 7 is an exploded perspective view of a chill plate, retention ring, and spacer in accordance with an example embodiment.

As shown in FIGS. 4 & 7, the chill plate 10 is held in place on a spacer 21 by a chill plate retention ring 16, which allows the chill plate 10 to move axially (i.e., along the same axis as the ram, indicated by the arrow in FIG. 1). As discussed, the chill plate 10 is held against the die 43 by chill plate spring 15. The chill plate spring 15 may be an annular wave spring (see FIG. 8A) as shown, but could also be comprised of multiple coil springs or an annular spring made from a resilient material, such as a compressible polymeric material. As best shown in FIGS. 1 & 7, the wave spring 15 may be retained in an annular spring groove 23 in spacer 21, although other configurations are possible, such as a channel in the chill plate 10 or holes in the spacer 21 to retain coil springs.

A small amount of movement of the chill plate may be desirable so that the chill plate spring 15 can urge the front surface of the chill plate 10 into close contact with the back side of an associated can-forming die 43, resulting in good thermal coupling. The retention ring 16 holds the chill plate 10 in place in the bodymaker, while at the same time allowing it to move as noted. The retention ring 16 is screwed into spacer 21 with countersunk screws 19, and the innermost portion of the retention ring 16 contacts the shoulder 18 of the chill plate 10 to hold it in position both radially and axially.

C. Floating Die Module and Spacer

Figure 2:
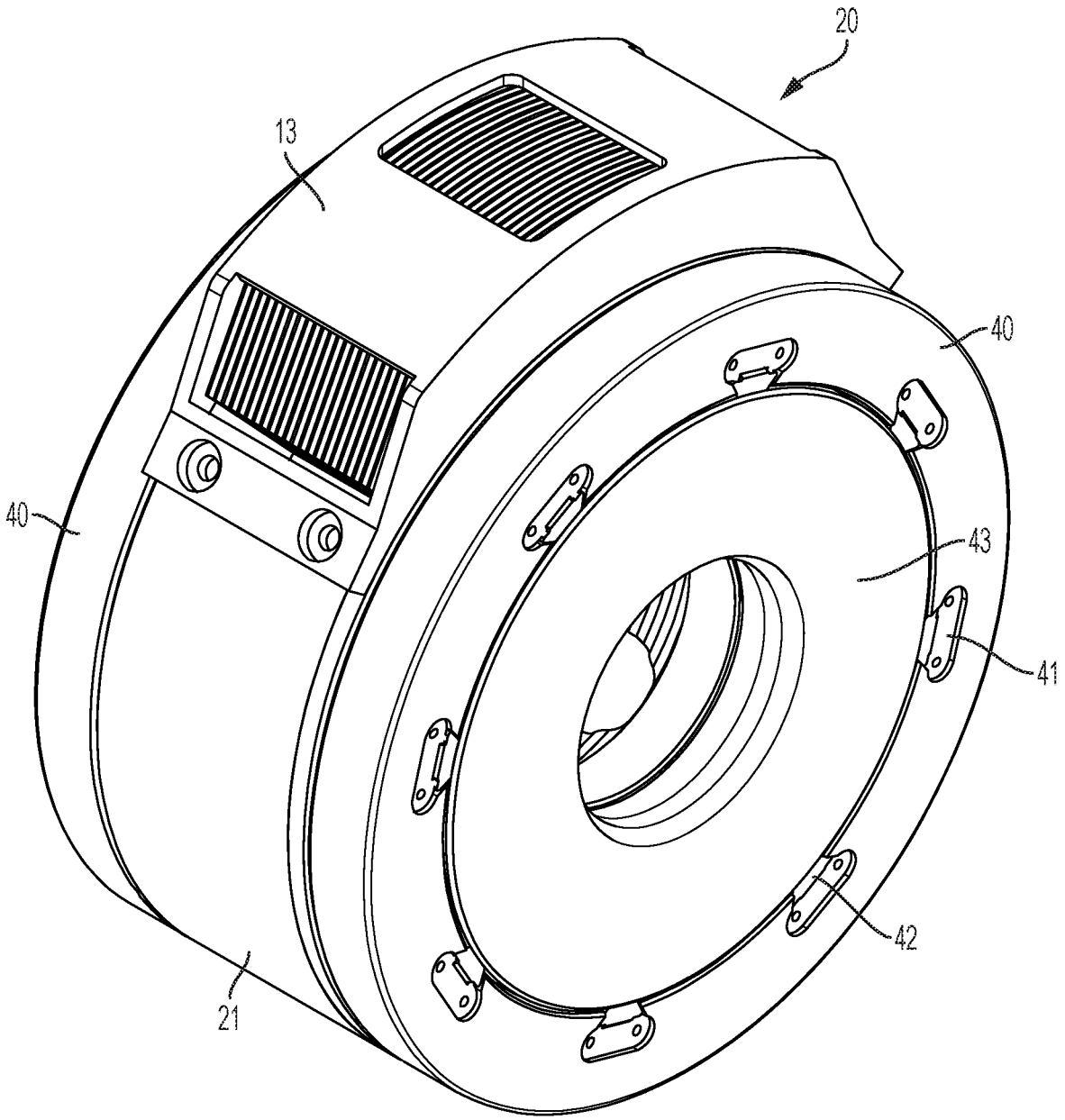
FIG. 2 is another perspective view of a toolpack module in accordance with an example embodiment.
Figure 3A:
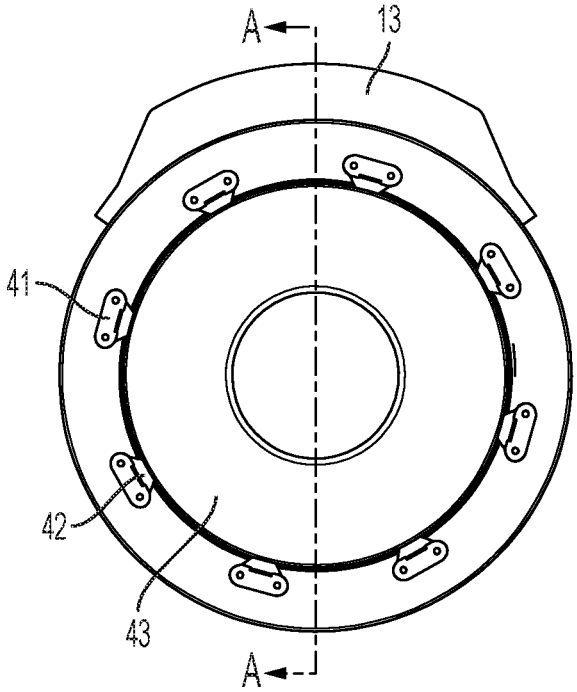
FIG. 3A is an end view of a toolpack module in accordance with an example embodiment.
Figure 3B:
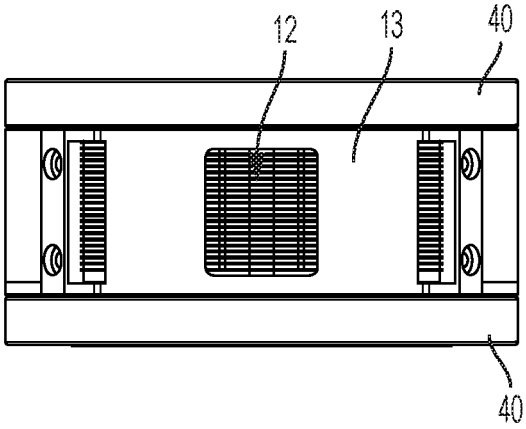
FIG. 3B is a top view of a toolpack module in accordance with an example embodiment.
Figure 3C:
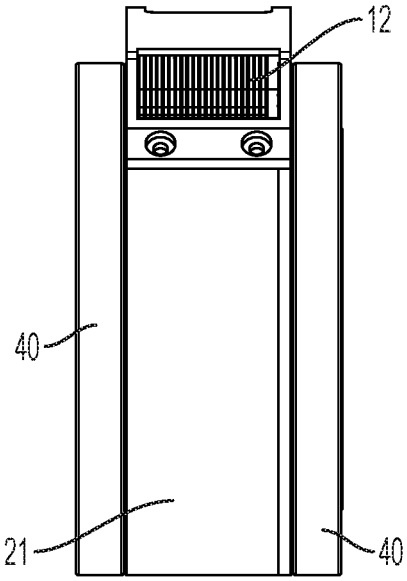
FIG. 3C is a side view of a toolpack module in accordance with an example embodiment.

The example embodiment may be used with a bodymaker comprising one or more floating die modules. As discussed briefly above, each floating die module holds a can-forming die 43 in place with multiple floating die module springs 41 and floating die module support pins 42 that hold the die in place while allowing it to float and self-center in the event of off-center hits from the ram, or misalignment from any cause. As shown in FIG. 2, two dies (or more) can be used in the example embodiment, separated by a spacer 21. The spacer 21 can also include a vacuum or waste port 22 for the removal of swarf or debris created during the can-making process. The waste port 22 connects the interior of the spacer 21 to the exterior of the spacer, where any unwanted material in the interior of the spacer can be removed, for example, by a vacuum line attached to or manifolded to, the waste port 22. As also shown in FIG. 2, the spacer 21 creates a gap between the floating die modules. This space allows room for the heatsink fins 12 and heatsink shroud 13 between the dies 43.

As best shown in FIG. 7, the spacer 21 and chill plate 10 can be assembled into a unit that is robust enough for industrial environments, while at the same time, the spring-biased attachment of chill plate 10 to spacer 21 allows the chill plate 10 to move into contact with the can-forming die 43 to establish good thermal coupling. As also shown, posts in the spacer 21 can be inserted through the heatsink fins 12 of the chill plate 10, and then screws 19 pass through holes in the retention ring 16 and into the posts, further securing the chill plate in the assembly.

Figure 9:
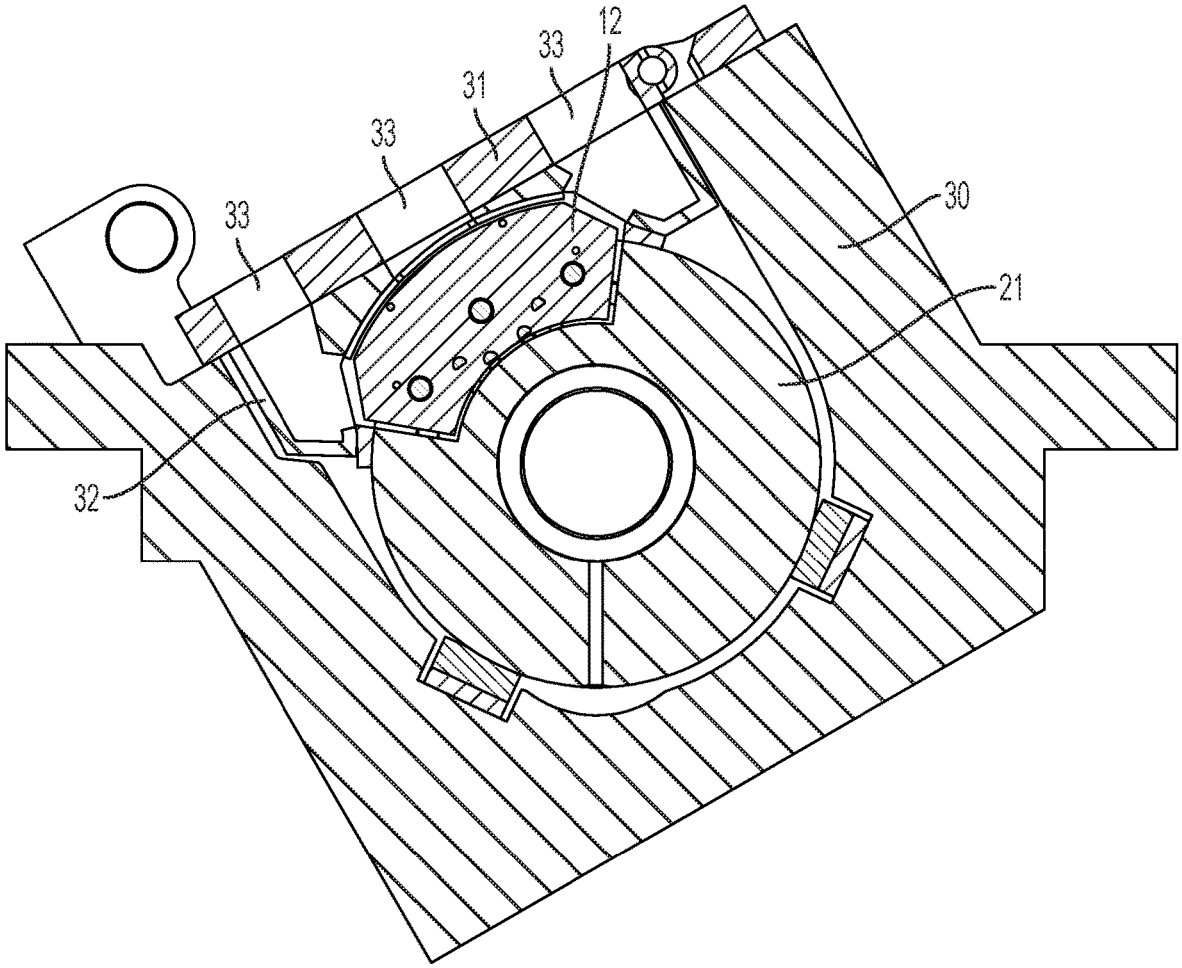
FIG. 9 is cross sectional view of a toolpack module installed in a bodymaker cradle in accordance with an example embodiment.

The spacer 21 provides a mounting base for the chill plate 10, chill plate retention ring 16, and also provides a base for chill plate spring 15, which biases the chill plate 10 away from the spacer 21 and toward die 43. Together, the spacer 21 and the floating die modules, the dies 43 and the chill plate 10 comprise a toolpack module 20. As is known, the toolpack module is designed and constructed for placement into a bodymaker toolpack cradle 30 as shown in FIG. 9. As also known, the bodymaker toolpack cradle 30 can hold other components used for making can bodies, such as a bottom former (not shown) as well as other bodymaker elements. The bodymaker 30 also includes a bodymaker cradle lid 31 which holds the toolpack module 20 firmly within the cradle. As best shown in FIG. 9, the bodymaker cradle lid 31 in an example embodiment includes a lid seal 32 and a number of lid inlets and outlets 33 that interface with the cooling inlets and outlets 14 of shroud 13. Cooling or heating fluid can flow through the inlets and outlets as necessary to heat or cool the chill plate, without allowing the fluid to contact or contaminate the cans. The shroud surrounding the heatsink fins 12 as well as the lid seal/manifold 32 of the bodymaker cradle lid 31 keep the cooling fluid flowing just over the heatsink fins 12, preventing it from entering the central portion of the bodymaker.

D. Operation of Preferred Embodiment

In use, the can-making process will generate heat in the dies which must be removed. In other systems, unwanted heat is removed by allowing cooling and lubricating fluid to flow over the inner portion of a bodymaker during can making. This fluid must then be removed in a separate process before cans can be finished, filled and used. In an example embodiment, instead of direct liquid cooling, heat pipes are used to carry heat away (or toward) the chill plate 10 and thus the associated dies, which cools the dies without allowing any cooling fluid to contact the cans being made or the interior of the can bodymaker.

The heat is transferred from the heat pipes 11 around the chill plate 10 to the heatsink fins 12 near the top of the toolpack module 20, and the heatsink fins 12 in turn are cooled by a cooling medium, which flows over the heatsink fins 12 within shroud 13, using fluid-tight connections to prevent fluid from entering the interior of toolpack module 20. The isolation of the cooling fluid from the interior of the can bodymaker allows cans to exit the bodymaker in a clean state, The chill plate 10 may include a temperature sensor 50, which can be used in conjunction with a controller 62 to regulate the temperature of the chill plate. If so, the controller can be used to control a valve 61 that controls the flow of cooling fluid supplied to the heatsink fins 12 of the chill plate, through the bodymaker cradle lid. Alternatively, the chill plate can be used without a temperature controller, in which case the thermal efficiency of the chill plate 10, as well as the flow rate and temperature of the cooling fluid, will determine how much heat is removed from the die.

Unless otherwise defined, all technical and scientific terms used herein have the same meaning as commonly understood by one of ordinary skill in the art to which this invention belongs. Although methods and materials similar to or equivalent to those described herein can be used in the practice or testing of the fluid-cooled toolpack, suitable methods and materials are described above. All publications, patent applications, patents, and other references mentioned herein are incorporated by reference in their entirety to the extent allowed by applicable law and regulations. The fluid-cooled toolpack may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A chill plate, comprising:

a generally ring-shaped chill plate body having a central opening;

at least one annular groove in a first surface of the chill plate body, surrounding the central opening;

at least one heat pipe having an annular portion and a straight end portion, the annular portion and the straight end portion defining planes perpendicular to each other, the straight end portion extending beyond the at least one annular groove, and the annular portion positioned within the at least one annular groove and in thermal contact with the chill plate body;

a plurality of heatsink fins thermally coupled with the straight end portion of the at least one heat pipe, wherein the plurality of heatsink fins are parallel to each other and to the first surface of the chill plate body; and a shroud enclosing the plurality of heatsink fins such that a liquid can be contained within the shroud, wherein the liquid can flow over the plurality of heatsink fins within the shroud, and wherein the plurality of heatsink fins are exposed to the liquid within the shroud such that heat can be transferred from the heatsink fins to the liquid;

wherein the at least one heat pipe transfers heat between the chill plate body and the plurality of heatsink fins.

2. The chill plate of claim 1, wherein the chill plate body comprises a substantially planar surface opposite the first surface, the substantially planar surface thermally coupled to a surface of a can-forming die.

3. The chill plate of claim 2, wherein the chill plate transfers heat from the can-forming die to the heatsink fins.

4. The chill plate of claim 1, wherein the shroud comprises a plurality of liquid openings such that the liquid can enter one of the liquid openings, flow over the plurality of heatsink fins, and leave the shroud through another liquid opening.

5. The chill plate of claim 1, further comprising a temperature sensor on the chill plate to detect the temperature of the chill plate body.

6. The chill plate of claim 1, wherein the at least one annular groove comprises two annular grooves, and wherein the at least one heat pipe comprises two heat pipes.

7. A toolpack assembly comprising:

a can-forming die having a general ring shape;

a tool pack member comprising a spring-holding recess;

a chill plate having a generally ring-shaped chill plate body with a central opening, a first surface, and a second surface, the first surface and the second surface being planar and parallel to each other, the chill plate body being positioned between the can-forming die and the toolpack member, the second surface in contact with the can-forming die;

at least one annular groove in the first surface of the chill plate body, surrounding the central opening;

at least one heat pipe having an annular portion and a straight end portion, and the straight end portion defining planes perpendicular to each other, the straight end portion extending beyond the at least one annular groove, and the annular portion positioned within the at least one annular groove and thermally coupled to the chill plate body;

a plurality of heatsink fins thermally coupled to the straight end portion of the at least one heat pipe, wherein the plurality of heatsink fins are parallel to each other and to the first surface of the chill plate body;

a shroud enclosing the plurality of heatsink fins such that a liquid can be contained within the shroud and can flow over the plurality of heatsink fins within the shroud, such that heat can be transferred from the heatsink fins to the liquid, wherein the plurality of heatsink fins are exposed to the liquid; and a spring in the spring-holding recess and in contact with the first surface, the spring positioned between the chill plate body and the tool pack member to bias the chill plate body into contact with the can-forming die.

8. The toolpack assembly of claim 7, wherein the second surface of the chill plate body is substantially planar and contacts a back surface of the can-forming die.

9. The toolpack assembly of claim 7, further comprising a retention member to attach the chill plate to the toolpack member, wherein the retention member allows limited movement of the chill plate.

10. The toolpack assembly of claim 7, wherein the shroud comprises a plurality of liquid openings such that the liquid can enter one of the liquid openings, flow over the plurality of heatsink fins, and exit the shroud through another liquid opening.

11. The toolpack assembly of claim 7, further comprising a temperature sensor on the chill plate to detect the temperature of the chill plate body.

12. The toolpack assembly of claim 7, wherein the at least one annular groove comprises two annular grooves, and wherein the at least one heat pipe comprises two heat pipes.

13. The toolpack assembly of claim 7, wherein the toolpack member is generally ring shaped with an outer surface and a central chamber, further comprising a channel forming an opening between the central chamber and the outer surface.

14. The toolpack assembly of claim 8, further comprising a retention member to attach the chill plate to the toolpack member, wherein the retention member allows limited movement of the chill plate.

15. The toolpack assembly of claim 7, wherein the shroud comprises a plurality of liquid openings, the at least one annular groove comprises two annular grooves, and wherein the at least one heat pipe comprises two heat pipes, further comprising:

a temperature sensor on the chill plate to detect the temperature of the chill plate body.

16. A toolpack assembly comprising:

a can-forming die having a general ring shape;

a toolpack member comprising a spring-holding recess;

a chill plate having a generally ring-shaped chill plate body with a central opening, a planar first surface, and a planar second surface opposite to and parallel to the first surface, the chill plate body being positioned between the can-forming die and the toolpack member;

wherein the second surface of the chill plate body is substantially planar and contacts a back surface of the can-forming die;

at least one annular groove in the first surface of the chill plate body, the at least one annular groove formed around the central opening;

at least one heat pipe having an annular portion and a straight end portion, the annular portion and the straight end portion defining planes perpendicular to each other, the straight end portion extending beyond the at least one annular groove, and the annular portion positioned within the at least one annular groove and thermally coupled to the chill plate body;

a plurality of heatsink fins thermally coupled to the straight end portion of the at least one heat pipe, wherein the plurality of heatsink fins are parallel to each other and to the first surface of the chill plate body;

a shroud enclosing and surrounding the plurality of heatsink fins such that a liquid can be contained within the shroud and can flow over the plurality of heatsink fins within the shroud, such that heat can be transferred from the heatsink fins to the liquid, wherein the plurality of heatsink fins are exposed to the liquid;

wherein the shroud comprises a plurality of liquid openings such that the liquid can enter a liquid opening, flow over the plurality of heatsink fins, and exit the shroud through another liquid opening; and a spring in the spring-holding recess and in contact with the first surface, the spring positioned between the first surface of the chill plate body and the toolpack member to bias the second surface of the chill plate body into contact with the can-forming die.

* * * * *